US007503799B2

(12) United States Patent
Keith et al.

(10) Patent No.: US 7,503,799 B2
(45) Date of Patent: Mar. 17, 2009

(54) COMMUNICATIONS PLUG WITH REVERSE CORDAGE AND ANTI-SNAG CONFIGURATION

(75) Inventors: Scott Martin Keith, Plano, TX (US); Golam Mabud Choudhury, Warren, NJ (US)

(73) Assignee: CommScope Inc., Hickory, NC (US)

( * ) Notice: Subject to any disclaimer, the term of this patent is extended or adjusted under 35 U.S.C. 154(b) by 0 days.

(21) Appl. No.: 11/845,275

(22) Filed: Aug. 27, 2007

(65) Prior Publication Data

US 2008/0050972 A1 Feb. 28, 2008

Related U.S. Application Data

(60) Provisional application No. 60/840,611, filed on Aug. 28, 2006.

(51) Int. Cl.
*H01R 4/24* (2006.01)

(52) U.S. Cl. ..... 439/417

(58) Field of Classification Search ..... 439/409, 439/676, 417–418
See application file for complete search history.

(56) References Cited

U.S. PATENT DOCUMENTS

| | | | | |
|---|---|---|---|---|
| 3,390,375 | A | 6/1968 | Salmonson | |
| 4,171,861 | A | 10/1979 | Hohorst | |
| 4,632,489 | A | 12/1986 | Skinner | |
| 5,156,551 | A | 10/1992 | Unger et al. | |
| 5,649,829 | A | 7/1997 | Miller et al. | |
| 5,718,604 | A | 2/1998 | Conorich et al. | |
| 5,762,518 | A * | 6/1998 | Tanigawa et al. | 439/409 |
| 6,159,020 | A | 12/2000 | Baker et al. | |
| 6,227,886 | B1 | 5/2001 | Baker et al. | |
| 6,325,660 | B1 | 12/2001 | Diaz et al. | |
| 6,379,174 | B1 | 4/2002 | Siemon et al. | |
| 6,439,911 | B1 | 8/2002 | Conorich | |
| 6,761,589 | B2 * | 7/2004 | Venditti et al. | 439/596 |
| 7,001,204 | B1 * | 2/2006 | Lin | 439/418 |

OTHER PUBLICATIONS

Invitation to Pay Additional Fees and Partial International Search Report for PCT/US2007/018808.
International Search Report with Written Opinion for PCT/US2007/018808 dated May 8, 2008.
PCT International Preliminary Report on Patentability corresponding to International Application No. PCT/US2007/018808 (8 pages); Date of Mailing: Sep. 18, 2008.

* cited by examiner

*Primary Examiner*—Jean F Duverne
(74) *Attorney, Agent, or Firm*—Myers Bigel Sibley & Sajovec

(57) ABSTRACT

A 110-style patch cord includes: a plug having opposed front and rear ends and a generally horizontal support surface; a plurality of electrical contacts mounted in the plug, each contact including a generally vertically oriented blade, the blades having exposed front edges positioned above the support surface and defining a first vertical plane; and a cable with a plurality of conductors, wherein each contact is electrically connected to a respective one of the conductors, the cable extending from the front end of the plug. At least one anti-snagging gusset is mounted on the support surface in front of the first plane.

21 Claims, 16 Drawing Sheets

COMMUNICATIONS PLUG WITH REVERSE CORDAGE AND ANTI-SNAG CONFIGURATION

RELATED APPLICATION

This application claims priority from U.S. Provisional Patent Application Ser. No. 60/840,611, filed Aug. 28, 2006, the disclosure of which is hereby incorporated herein in its entirety.

BACKGROUND OF THE INVENTION

The telecommunications and data management industries utilize connective hardware for general building wiring, premises distribution systems, local area networks, and other network applications. Connective hardware known as "110 connector systems" has become a standard of the industry because of the reliable gas-tight connection provided by a 110-style insulation displacement connector (IDC). This miniature quick-connect terminating system is listed or approved by Underwriters Laboratories, the Canadian Standards Association, and the Australian Standards Association. 110 connector systems have gained type approval from such countries as the United Kingdom, Japan, Korea, and others.

The 110 connector system consists of field-wired cable termination apparatus that is used to organize and administer cable and wiring installations. The main cross-connect is typically located in an equipment room and provides termination and cross-connection of network interface equipment, switching equipment, processor equipment, and backbone (riser or campus) wiring. The horizontal cross-connect is typically located in a telecommunications closet and provides termination and cross-connection of horizontal (relative to the work area) and backbone wiring. Cross-connects provide efficient and convenient routing and rerouting of common equipment circuits to various parts of a building or campus.

110 connector systems enable cable and wiring installations to be handled by technical or non-technical end user personnel. Line moves and rearrangement for the cabling terminated at a cross-connect can be performed with patchcords (plug-ended jumpers) or cross-connect wire. The patchcords are typically used where the highest system integrity is required.

Referring to FIG. 16, a 110 connector system typically includes a wiring block support structure known as a cable organizer 112. A conductor termination array (index strip) 114 is mounted upon the cable organizer 112. A cable cover 116 is juxtaposed with the cable organizer 112 to cover cable routing and provide a smooth surface to facilitate pulling out patchcord plugs. The cable organizer 112 elevates the index strip 114 to expand the jumper trough space between adjacent cable organizers. A plurality of connecting blocks 118 are plugged into the index strip 114 as needed. Patchcords are then plugged into the connecting blocks to make desired connections and/or rearrangements.

A "reverse-engaging" plug 136 for a patchcord that can be employed with a 110 connector system is described in U.S. Pat. No. 6,159,020 to Baker et al. and shown in FIGS. 16 and 17. The plug 136 includes an anti-snag feature that prevents the plug 136 from snagging on other cords in the trough space when the plug 136 is disconnected and dragged through the trough, where other cords are typically present. The anti-snag feature comprises a hinged cover 150 that rotates to cover the opening in the plug 136 that receives the index strip 114. By covering this opening, the cover 150 prevents other cords from being caught or snagged by the overhanging latch structure present on the plug 136.

Although the plug described in Baker et al. can successfully prevent snagging of a reverse-engaging plug, it may be desirable to provide alternative configurations, particularly those that lack components that must be moved into or out of operative positions to avoid snagging.

SUMMARY OF THE INVENTION

As a first aspect, embodiments of the present invention are directed to a 110-style patch cord, comprising: a plug having opposed front and rear ends and a generally horizontal support surface; a plurality of electrical contacts mounted in the plug, each contact including a generally vertically oriented blade, the blades having at least partially exposed front edges positioned above the support surface and defining a generally vertical first plane; and a cable with a plurality of conductors, wherein each contact is electrically connected to a respective one of the conductors, the cable extending from the front end of the plug. At least one anti-snagging gusset is mounted on the support surface in front of the first plane. In this configuration, the patch cord can be removed from a communications rack with a reduced risk of snagging on another cord present in the rack.

As a second aspect, embodiments of the present invention are directed to a method of terminating a patch cord having a plurality of electrical conductors, the conductors being arranged in differential pair. The method comprises the steps of: providing a base in which are mounted electrical contacts, each of the electrical contacts including a blade at one end and an IDC at the other end, the blades being generally vertically oriented, arranged in one or more generally horizontal rows, and extending in a forward direction; providing a cover comprising a plurality of generally vertically oriented grooves, each of the grooves sized to receive a conductor; inserting a cable comprising the plurality of conductors into an aperture located on a forward end of the base; inserting each of the conductors of the cable into a respective groove in the cover; and interconnecting the base and the cover such that the IDCs in the base form electrical contact with the conductors inserted in the grooves in the cover. This method can facilitate termination of the patch cord in the field.

DETAILED DESCRIPTION OF EMBODIMENTS OF THE INVENTION

Figure 1:
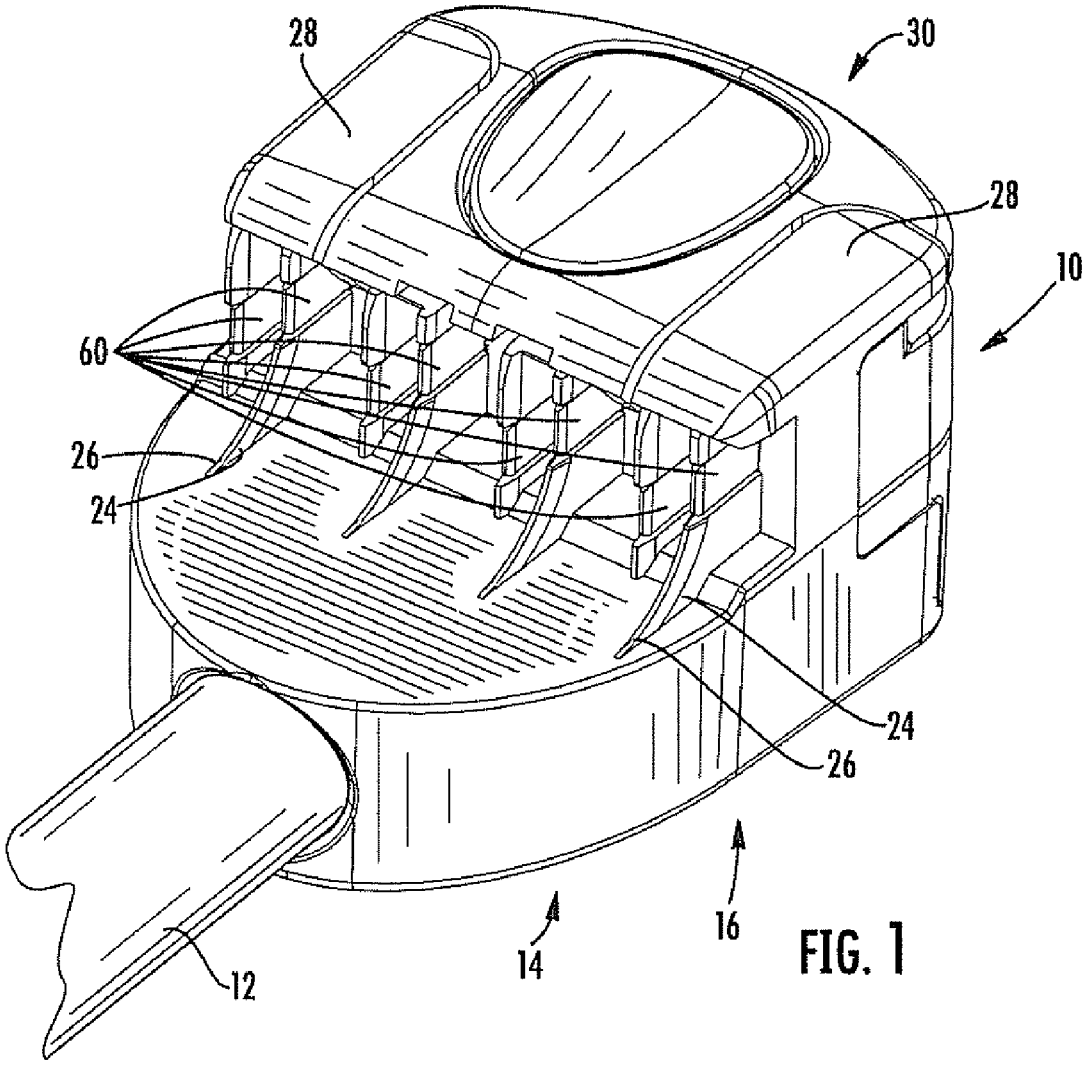
FIG. 1 is a front top perspective view of a communications plug and cord comprising a patch cord according to embodiments of the present invention.

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

It will be understood that when an element is referred to as being "coupled" or "connected" to another element, it can be directly coupled or connected to the other element or intervening elements may also be present. In contrast, when an element is referred to as being "directly coupled" or "directly connected" to another element, there are no intervening elements present. Like numbers refer to like elements throughout.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Well-known functions or constructions may not be described in detail for brevity and/or clarity.

As used herein the expression "and/or" includes any and all combinations of one or more of the associated listed items.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Figure 2:
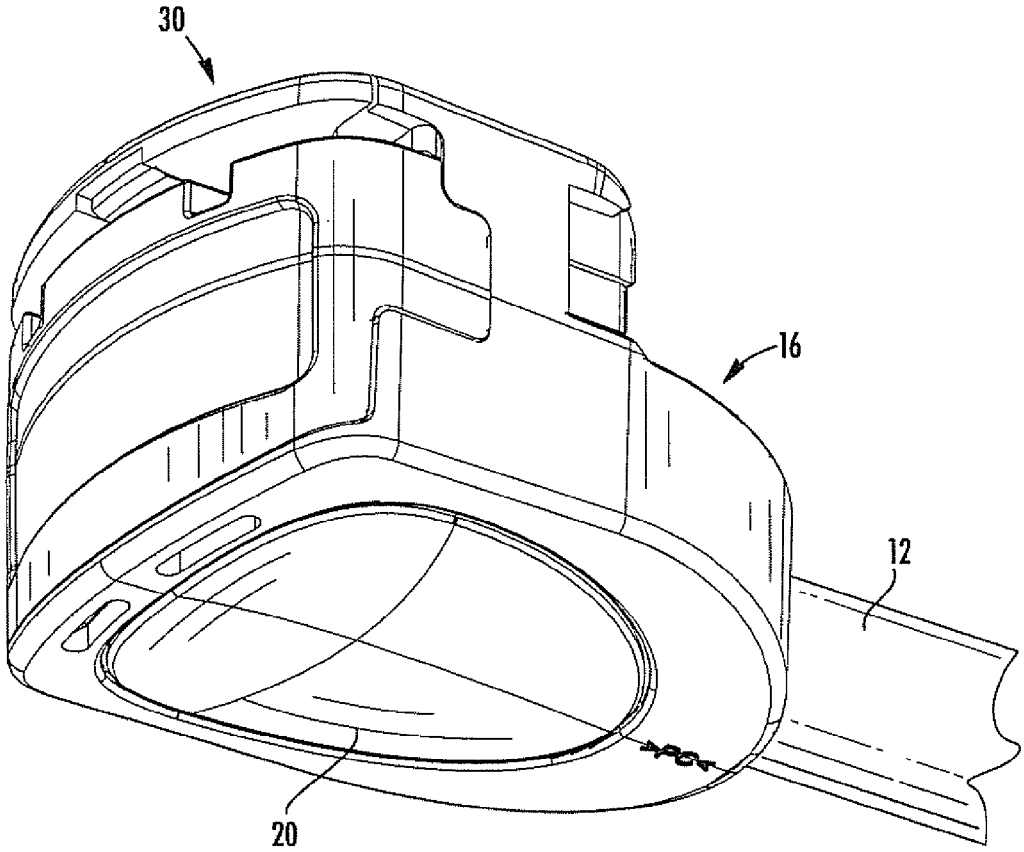
FIG. 2 is a rear bottom perspective view of the communications plug of FIG. 1.
Figure 11:
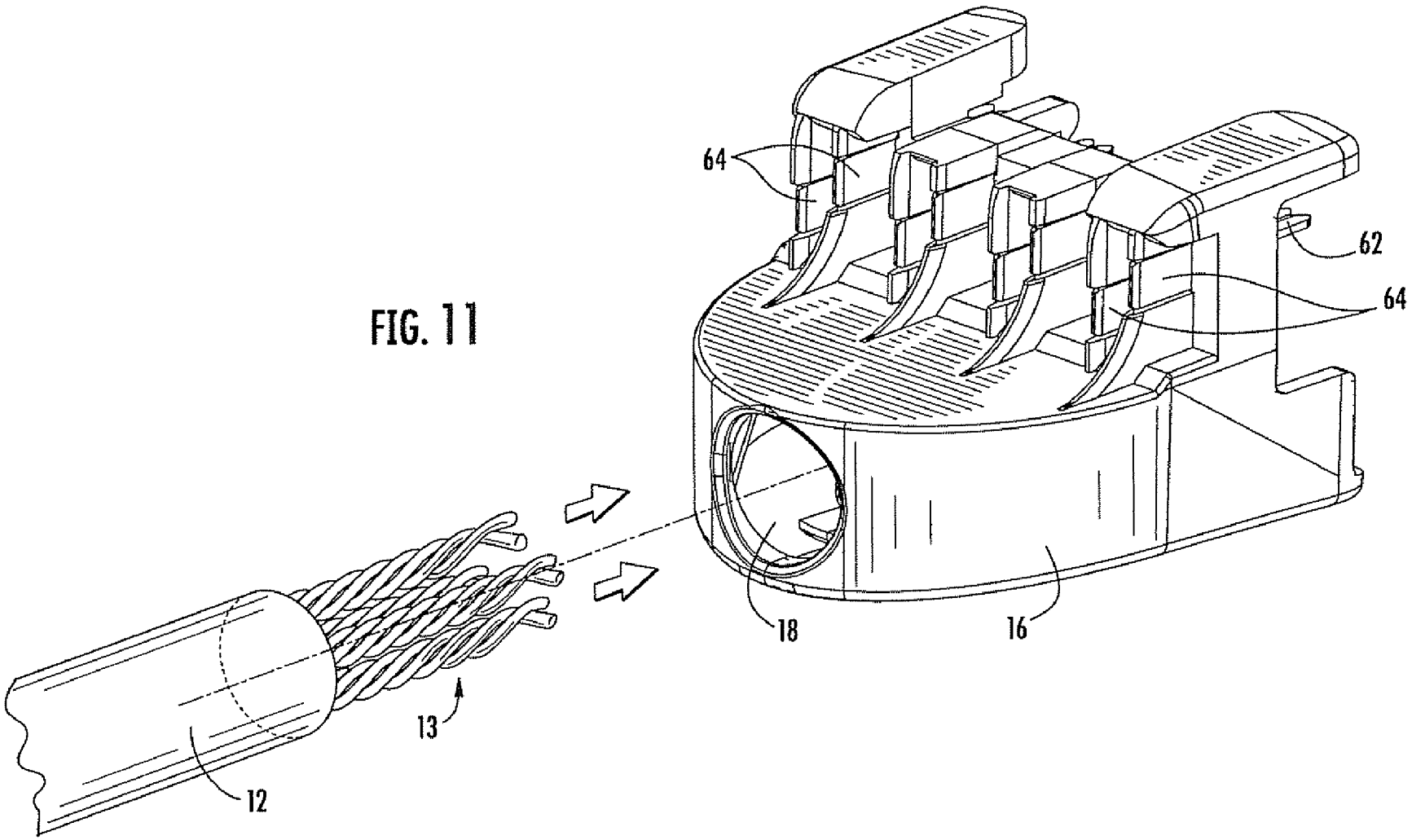
FIGS. 11-14 are sequential view illustrating the assembly of the patch cord of FIG. 1.
Figure 12:
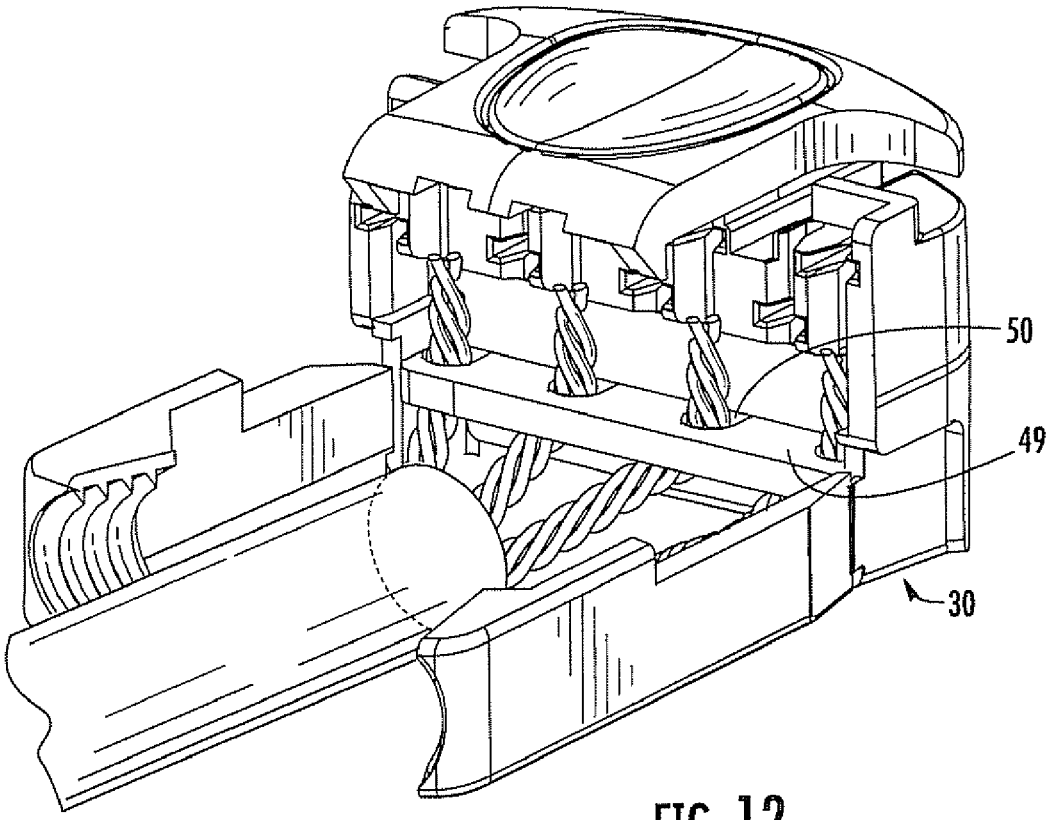

Referring now to the figures, a communications patch cord, designated broadly at 10, is illustrated in FIGS. 1 and 2. The patch cord includes a communications cable 12 (typically one that includes multiple twisted pairs, often four twisted pairs, of conductors—see FIGS. 11, 12 and 14) having a construction known to those skilled in this art. At one end, the patch cord 10 includes a plug 14 for interconnecting the patch cord 10 to a communications system, such as a telecommunications patch panel, connecting block, shelf or the like.

As shown in FIGS. 1 and 2, the plug 14 includes a base 16, a cover 30, and a plurality of contacts 60 (eight contacts are illustrated herein). These components are described in greater detail below.

Figure 3:
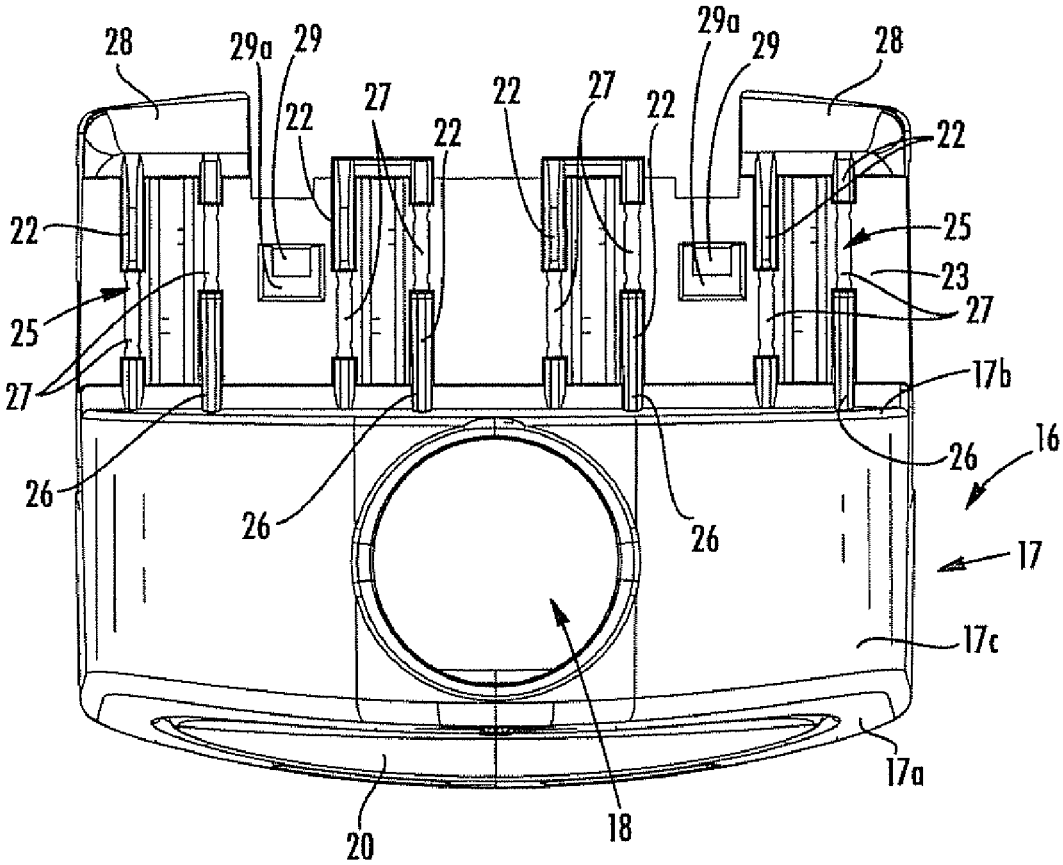
FIG. 3 is a front view of the base of the plug of FIG. 1.
Figure 4:
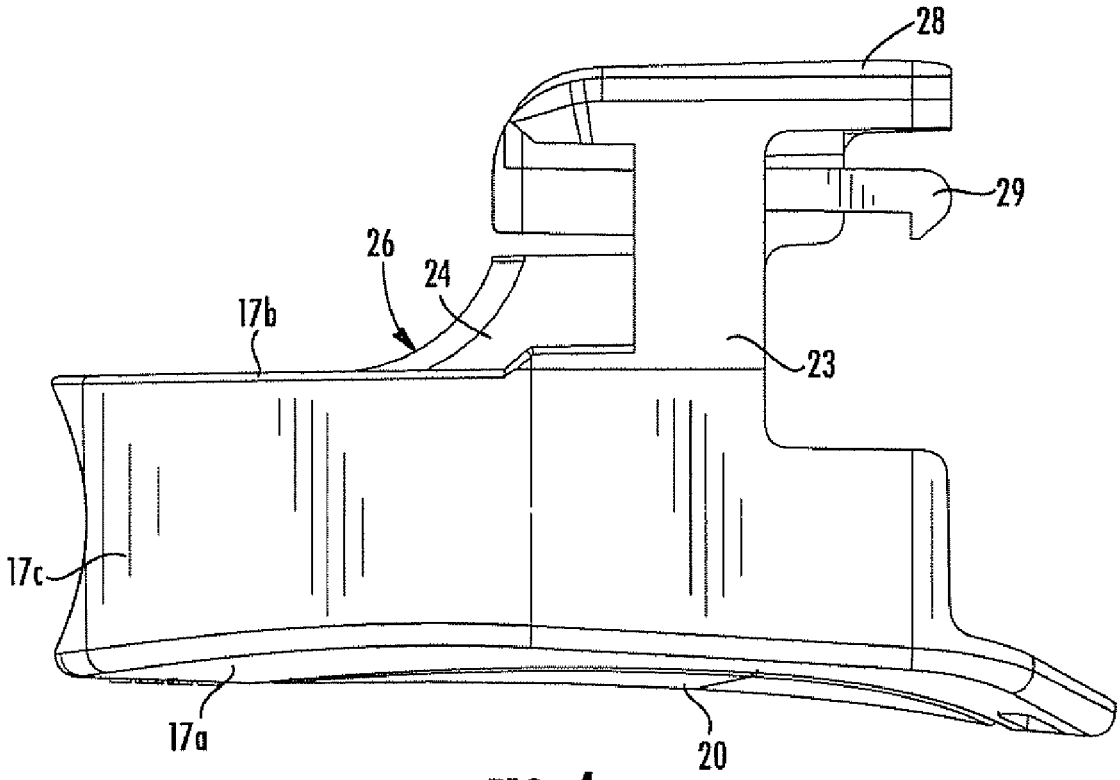
FIG. 4 is a side view of the base of FIG. 3.
Figure 5:
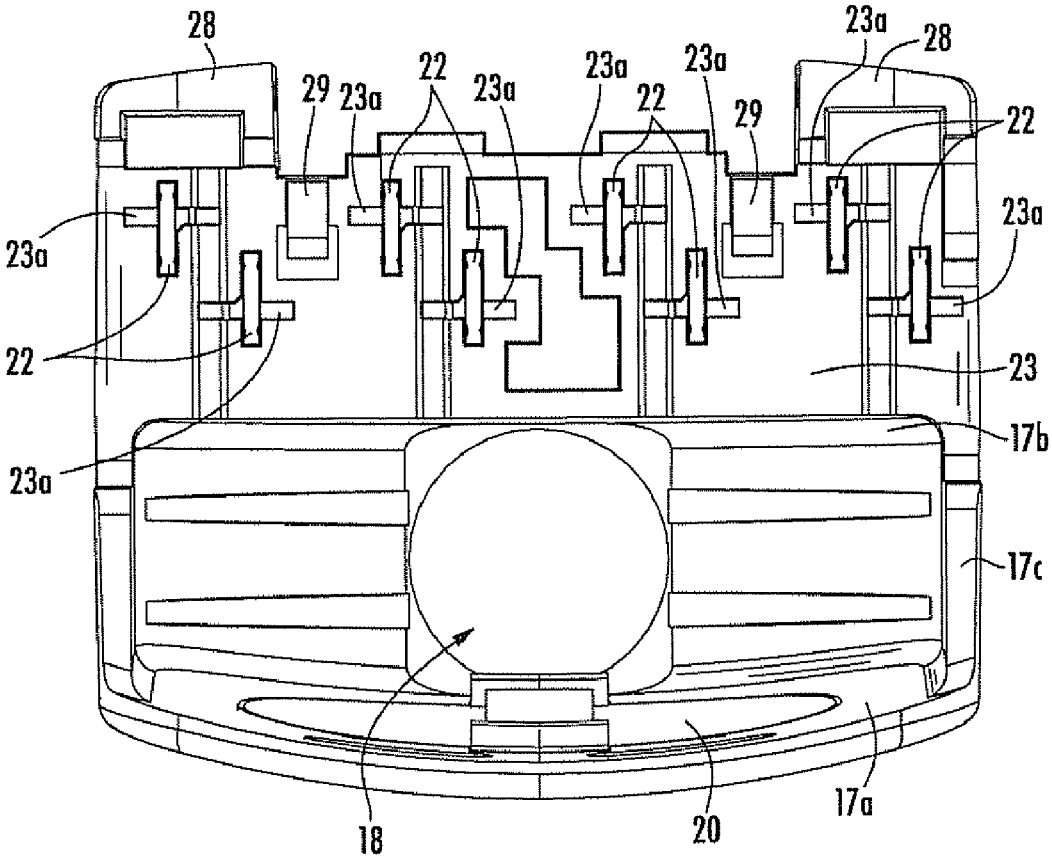
FIG. 5 is a rear view of the base of FIG. 3.
Figure 6:
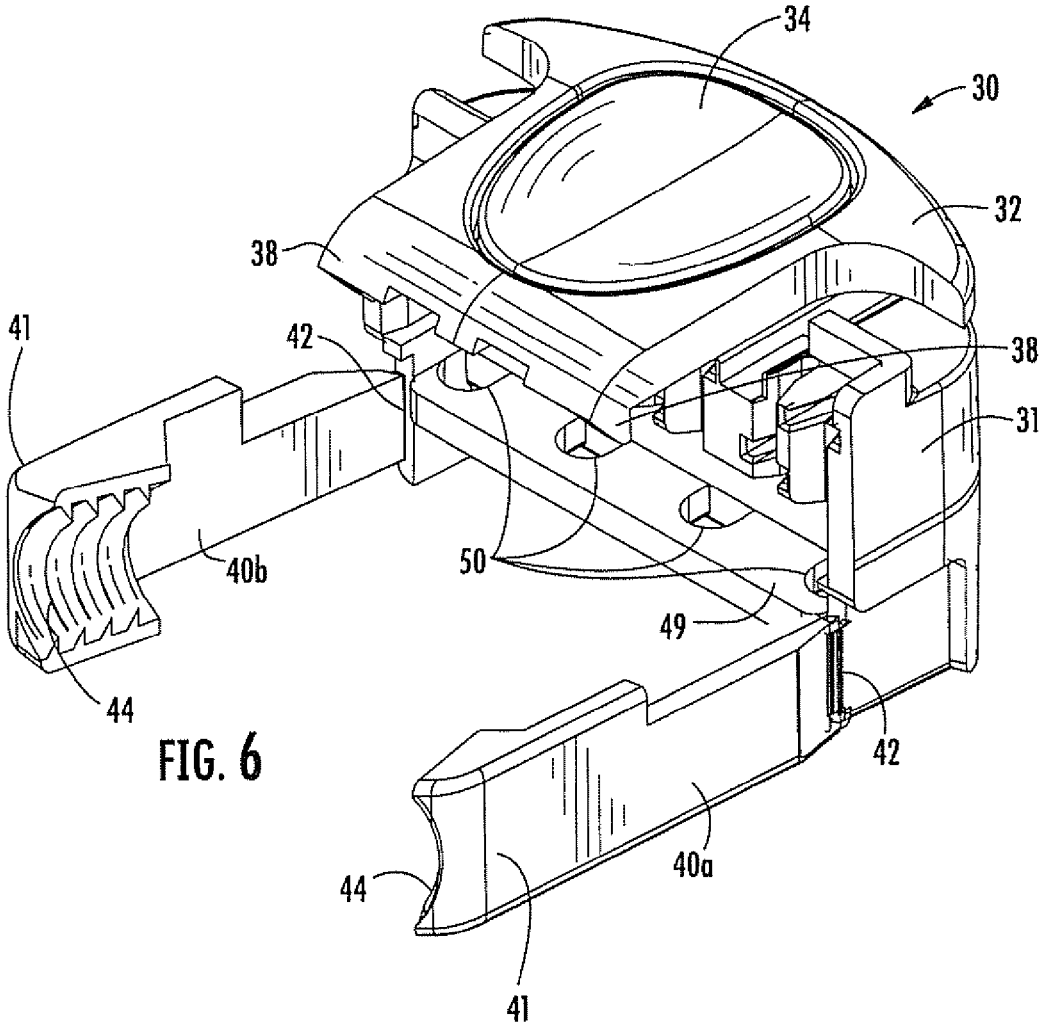
FIG. 6 is a top perspective view of the cover of the communications plug of FIG. 1.
Figure 7:
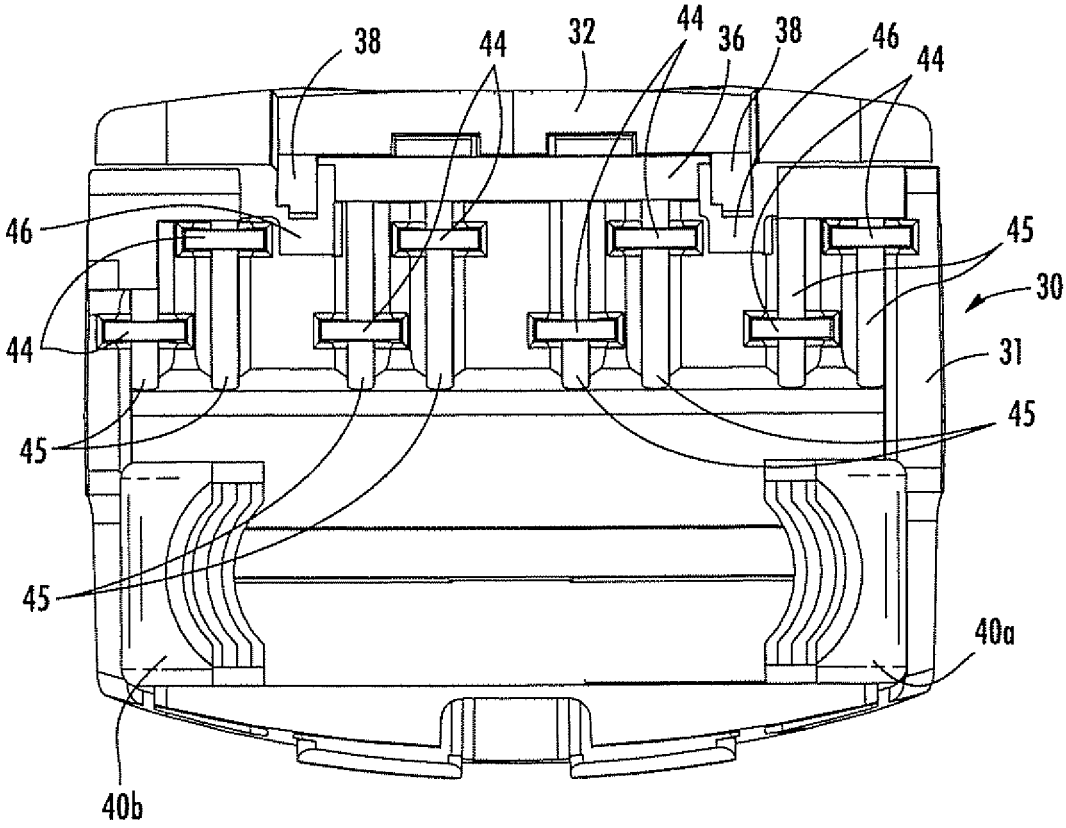
FIG. 7 is a front view of the cover of FIG. 6.
Figure 8:
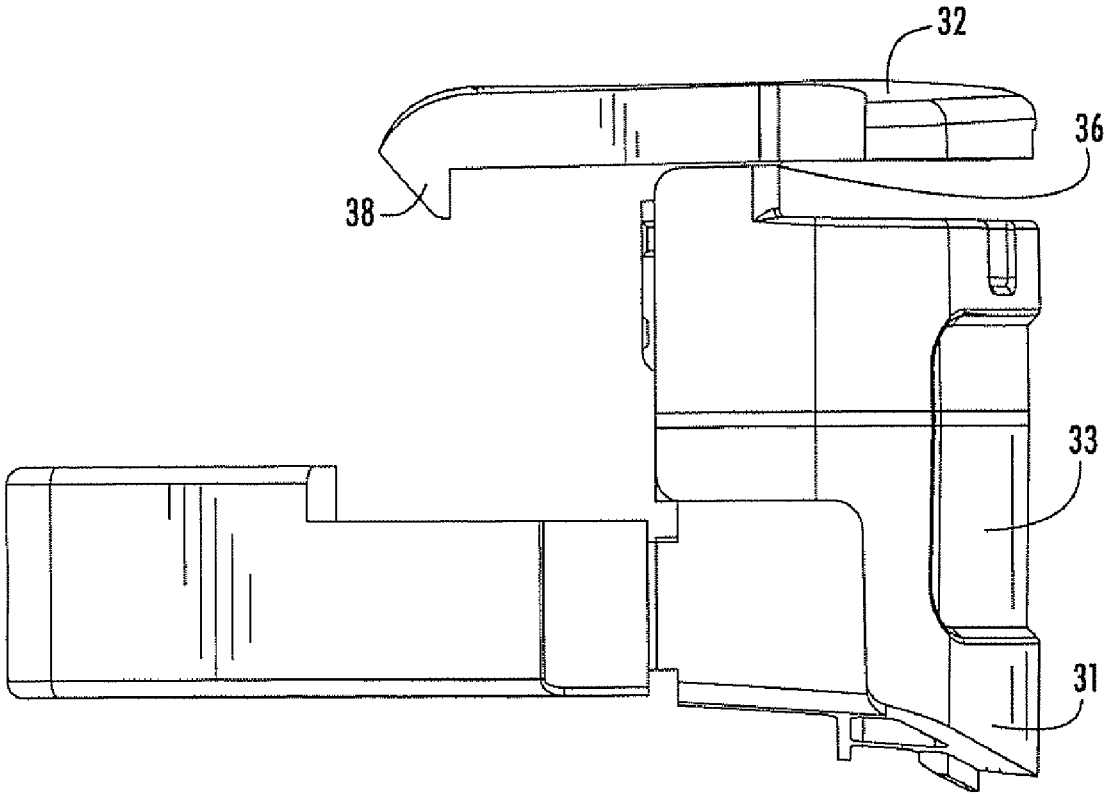
FIG. 8 is a side view of the cover of FIG. 6.
Figure 9:
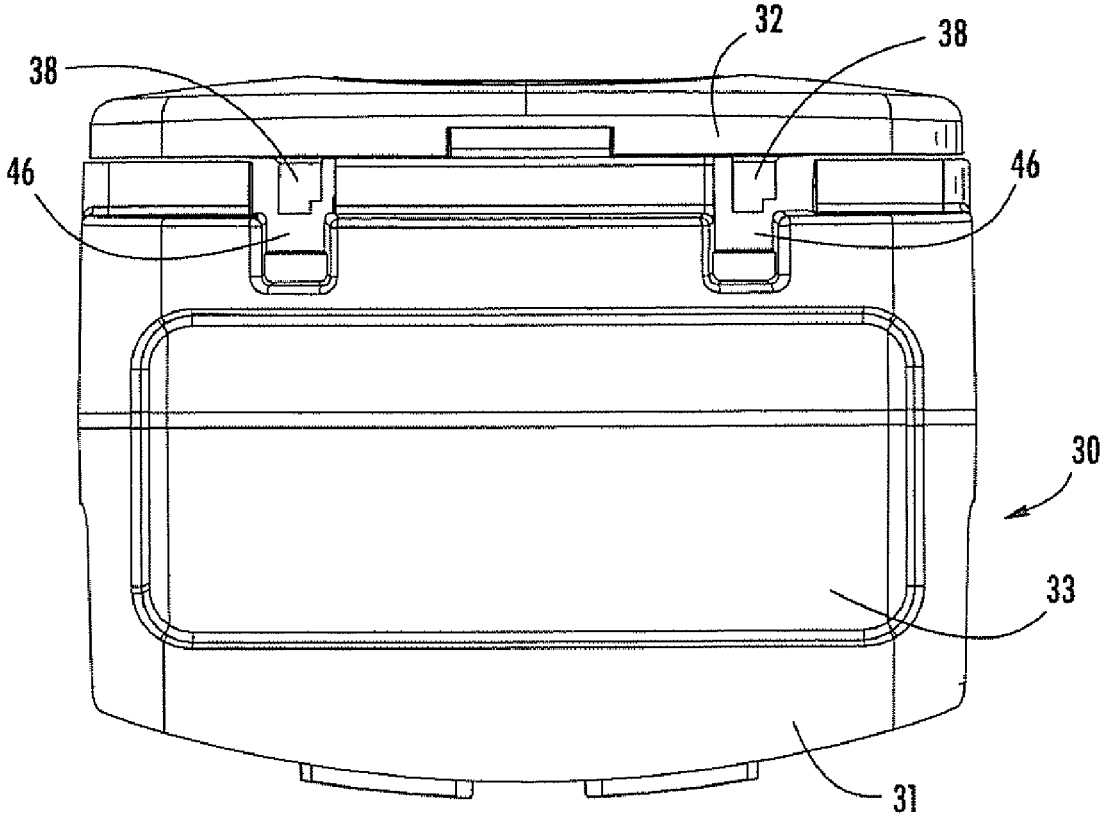
FIG. 9 is a rear view of the cover of FIG. 6.

Referring to FIGS. 3-5, the base 16 has a predominantly hollow lower body 17. The lower body includes a floor 17*a*, a support surface 17*b*, and a side wall 17*c* that merges with the floor 17*a* and support surface 17*b* to form an open-ended chamber. At the front end of the lower body 17 (i.e., the end that the cable 12 enters), the side wall 17*c* receives the cable 12 in a cable aperture 18. The front end of the lower body 17 has a generally rounded profile; the rear end of the lower body 17 is less rounded than the front end. On its lower surface, the floor 17*a* has a gripping pad 20, which is typically slightly concave (for receiving a user's thumb) and/or formed of a visually distinct material (for example, the gripping pad 20 may have a glossy surface).

Referring still to FIGS. 3-5, the base 16 also includes a blade wall 23 that rises from the support surface 17*b* and extends across the support surface 17*b* from side-to-side, and further includes a series of discontinuous blade partitions 22 that are vertically oriented and extend forwardly from the blade wall 23. The blade wall 23 includes eight contact slots 27 arranged in pairs and two latch apertures 29*a*; two latches 29 extend rearwardly from positions just above the latch apertures 29*a*. On its rear surface, the blade wall 23 includes eight horizontal grooves 23*a*. At their lower ends, four of the blade partitions 22 have gussets 24 that rise from the support surface 17*b* to present an array of forward-facing, smoothly-arced edges 26. The blade partitions 22 include recesses 25 in their discontinuities for receiving the contacts 60. Two upper wings 28 are positioned above the outermost pairs of contact slots 27.

The base 16 is typically formed from a polymeric material, such as polycarbonate or the like. The base 16 may be formed as an integral unit, or it may be formed in multiple pieces (e.g., the gripping pad 20 may be formed separately and attached in a separate operation).

Referring now to FIGS. 6-9, the cover 30 includes a generally vertical body 31 and a generally horizontal ceiling 32 that is attached to the body 31 via an integral "living" hinge 36. A label area 33 is located on the rear surface of the body 31. An upper gripping pad 34 is located on the tipper surface of the ceiling 32; like the lower gripping pad 20, the upper gripping pad 34 is typically slightly concave and/or formed of a visually distinct material. A pair of latch hooks 38 depend from the front edge of the ceiling 32. Two latch apertures 46 extend through the body 31; the latch apertures 46 have a stepped profile. On its front surface, the body 31 includes horizontally-disposed grooves 44 for receiving the contacts 60 and vertically-disposed grooves 45 that intersect the grooves 44 for receiving the conductors from the cord 12. The body 31 also includes a horizontally-disposed shelf 49 with conductor apertures 50 that provide passages from the underside of the shelf 49 to the grooves 45.

Referring again to FIGS. 6-9, two cable grip arms 40*a*, 40*b* originate from the outer edges of the body 31 and extend forwardly therefrom. A respective "living" hinge 42 interconnects each of grips arms 40*a*, 40*b* to the body 31. At their free ends 41, the grip arms 40*a*, 40*b* include inwardly-facing ridges 44. In some embodiments, the cable grip arms 40*a*, 40*b* extend substantially forwardly in a relaxed condition, such that they must deflect toward each other for their free ends 41 to come together.

The cover 30 is typically formed of a polymeric material, such as polycarbonate or the like. The cover 30 may be formed as an integral unit, or it may be formed in multiple pieces (e.g., the upper gripping pad 34 may be formed separately and attached in a separate operation).

Figure 10:
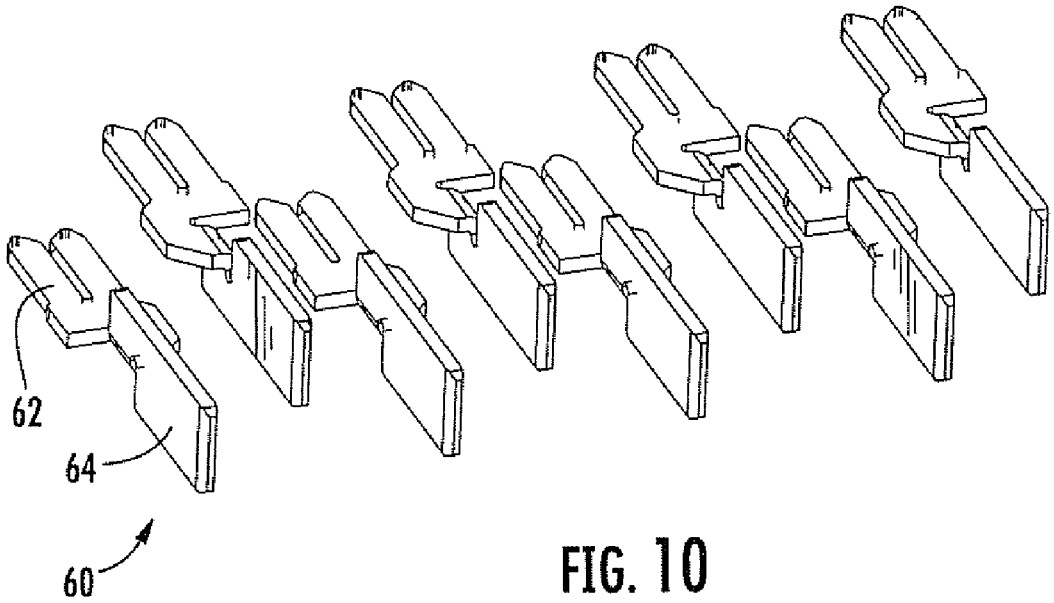
FIG. 10 is a front top perspective view of the contacts of the communications plug of FIG. 1.

Turning now to FIG. 10, each of the contacts 60 includes a pair of insulation displacement connector (IDC) prongs 62 at its rearward end and a blade 64 at its forward end. The contacts 60 may be formed in any configuration and of any material known to those skilled in this art to be appropriate for carrying electrical signals and need not be discussed in detail herein. Also, the contacts 60 may be arrayed in any arrangement known to be suitable to those skilled in this art.

Turning now to FIGS. 11-14, the assembly of the plug 14 with the cord 12 can be understood. The blades 60 are oriented such that the blades 64 of the contacts 60 are inserted into the contact slots 27 in the blade wall 23 of the base 16 such that the front ends of the IDC prongs 62 are inserted into the grooves 23*a* of the blade wall 23. In this configuration, the blades 64 are generally vertically oriented and are arranged in two horizontal rows, and the IDC prongs 62 are generally horizontally oriented. The front edges of the blades 64 define a generally vertical plane. Each of the gussets 26 is substantially coplanar with a respective blade 64.

Figure 13:
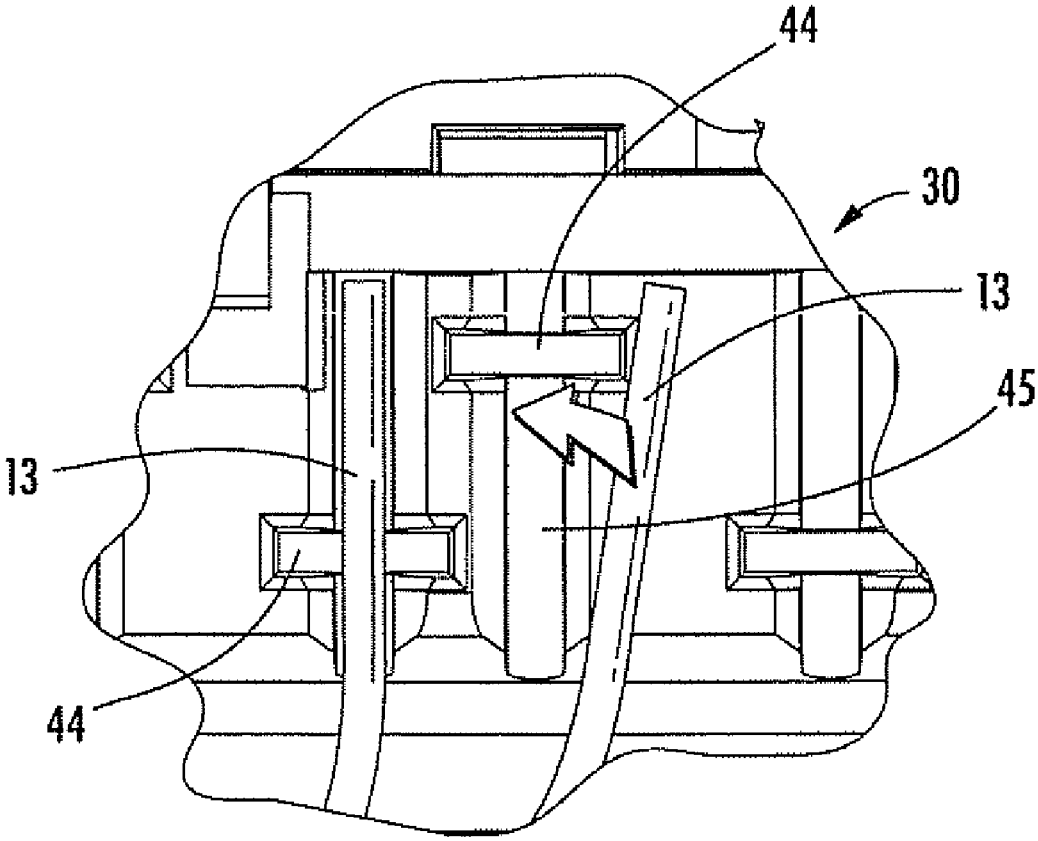
Figure 14:
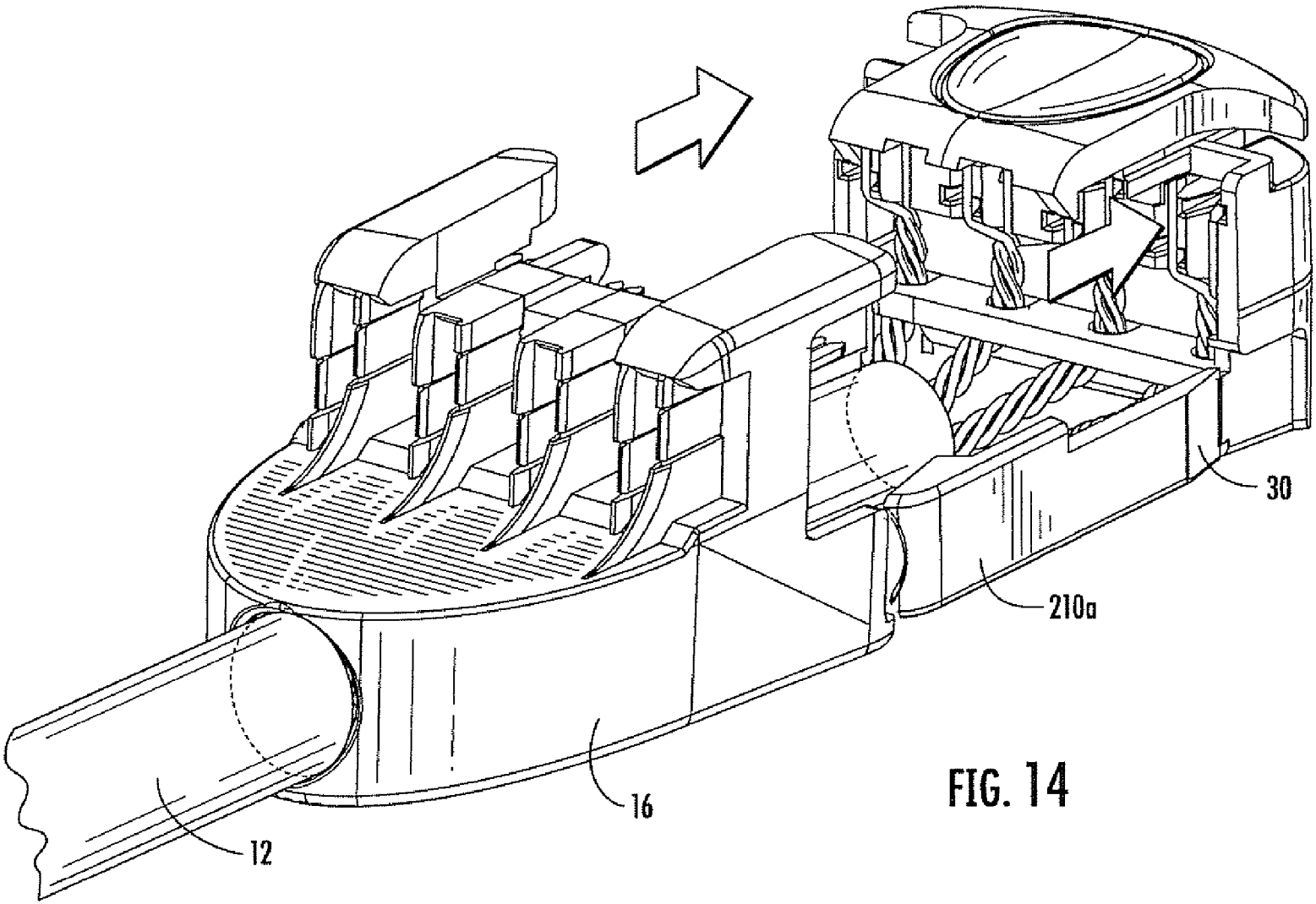

The cable 12 is inserted into the cable aperture 18 (FIG. 11), and the pairs of conductors 13 are separated. The conductors 13 are threaded in pairs through the conductor apertures 50 in the shelf 49 of the cover 30 (FIG. 12), then inserted individually into the grooves 45 of the cover 30 (FIG. 13). The cover 30 is then inserted into the base 16 (FIG. 14). Electrical interconnection is created between the conductors 13 and the contacts 60 as the prongs 62 of the contacts 60 are inserted into the horizontal grooves 44. The latches 29 of the base 16 are inserted into the latch recesses 46 of the cover 30 until the hooks of the latches 29 engage the stepped profile of the recesses 46. This engagement secures the cover 30 to the base 16. In addition, the cable grip arms 40*a*, 40*b* deflect about their respective hinges 42 until their free ends 41 meet (this can be seen in FIG. 1). The ridges 44 in the free ends "bite" into the insulation of the cable 12, thereby securing fixing the cable 12 and providing strain relief for the conductors 13.

The plug 10 can be attached to a patch panel, connecting block or the like by simply orienting the plug 10 so that the blades 62 face the mating connector on the patch panel and pushing the plug 10 into the connector to establish contact between the blades 62 and the contacts of the patch panel. In some embodiments, the latch hooks 38 of the cover 30 engage mating structure in the patch panel; because the ceiling 32 of the cover 30 is hinged to the body 31 via the hinge 36, the ceiling 32 is free to pivot relative to the body 31 to facilitate engagement of the latch hooks 38.

In addition, the plug 10 can be removed from the patch panel by gripping the plug 10 by the lower and upper grip pads 21, 34 and pressing them toward each other; this action causes the ceiling 32 to pivot upwardly so that the latch hooks 38 can disengage from the patch panel.

The smoothly-arcuate or sloped profile provided by the edges 26 of the gussets 24 of the blade partitions 22 in front of the plane defined by the front edges of the blades 64 can prevent a cord from this or another patch cord from snagging on the plug 10. In some prior plugs that have "reverse" cord orientation (in which the cord emerges from the plug in the same direction as the blades of the contacts face), there is a tendency for other cords in a patch panel or the like to snag on the plug in the region near the contact blades. The shapes of the gussets 24 can help to prevent such snagging of cords or other components. In addition, the ceiling 32 of the cover 30 does not extend in front of the plane defined by the front edges of the blades 64, which eliminates another potential snagging location.

Other "anti-snagging" gusset structures may also be employed. For example, the gusset edges may simply be straight and sloped relative to the blade partitions and the ceiling, or may be "stair-stepped" and sloped. The gussets may be thicker than illustrated, or even a single gusset or rib that slopes from the support surface to the blade partition may be employed.

Figure 15:
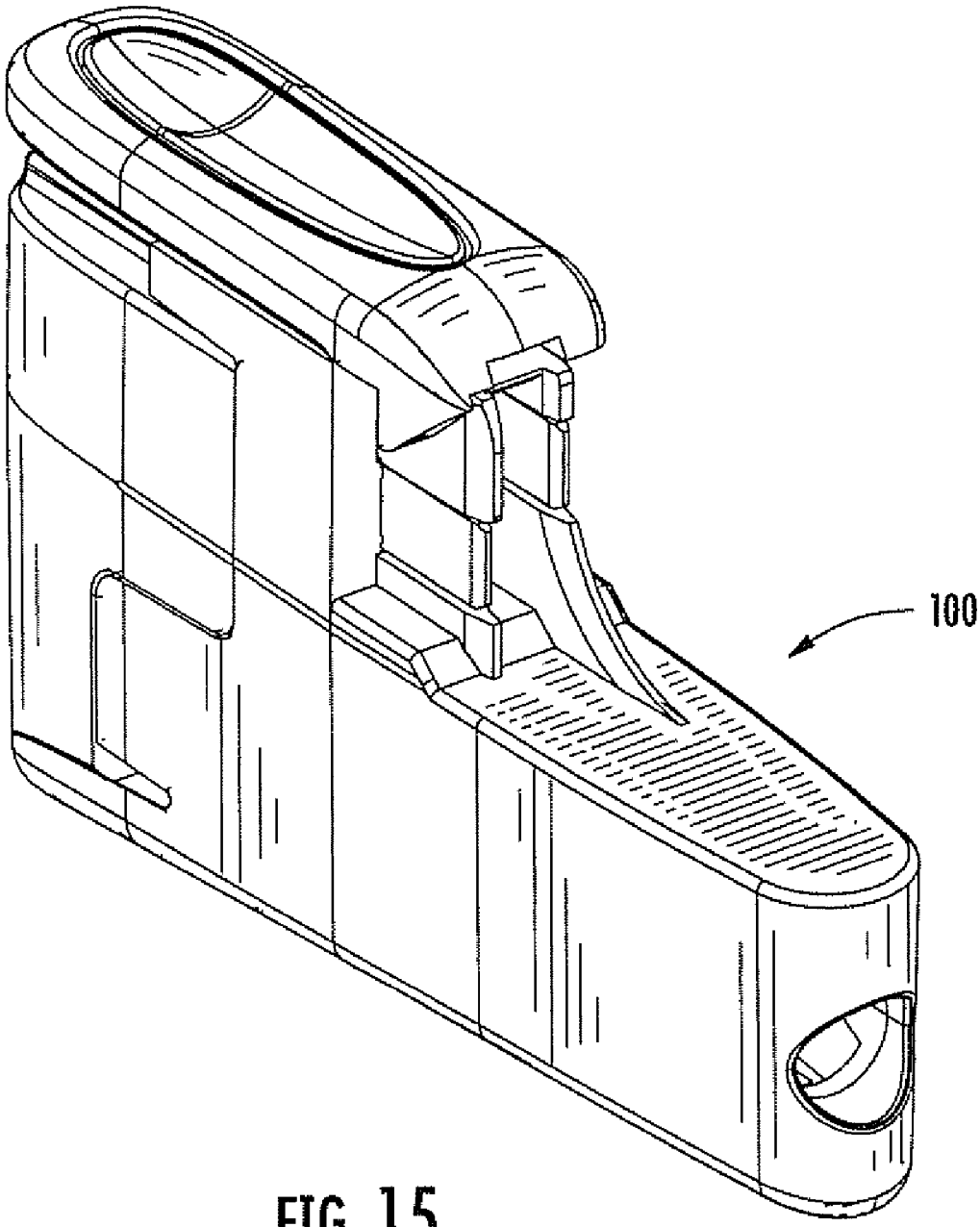
FIG. 15 is a top perspective view of an alternative communications plug and cord according to embodiments of the present invention.
Figure 16:
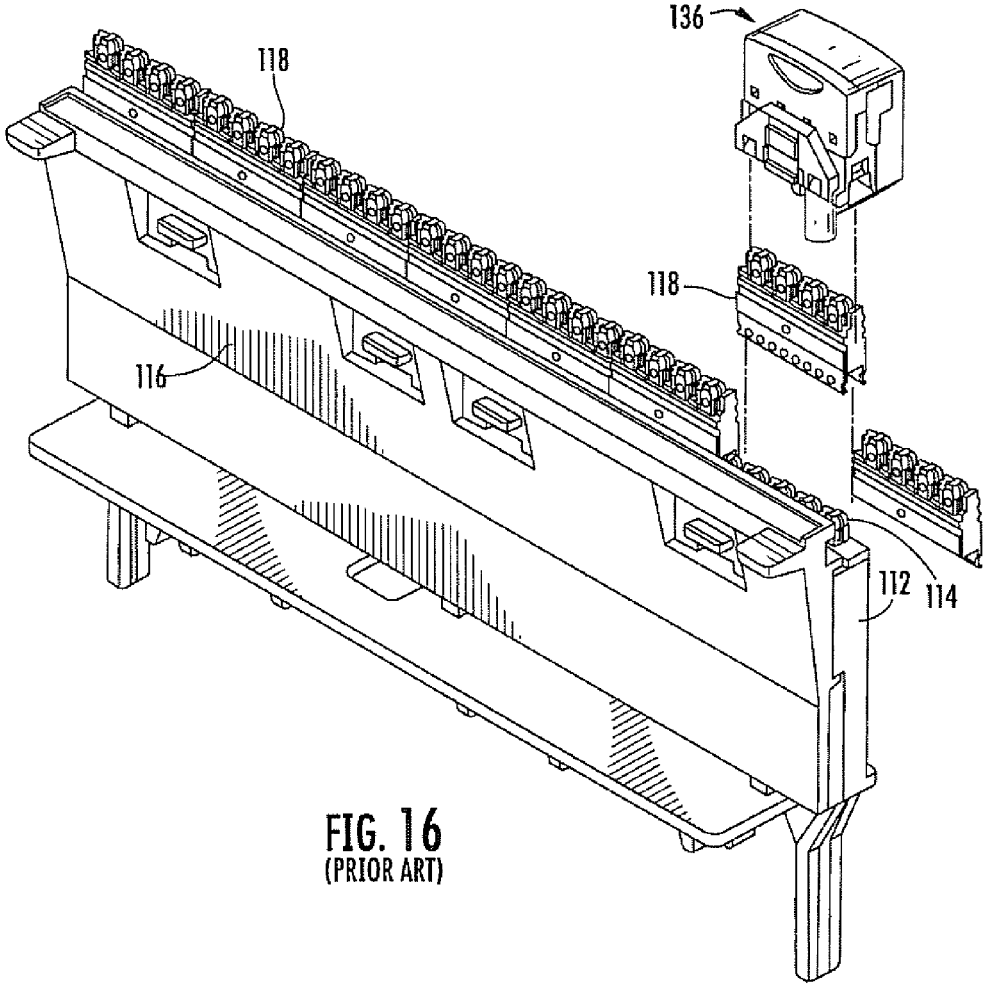
FIG. 16 (PRIOR ART)
FIG. 16 is a bottom perspective view of a prior art anti-snagging plug being connected to an index strip.
Figure 17:
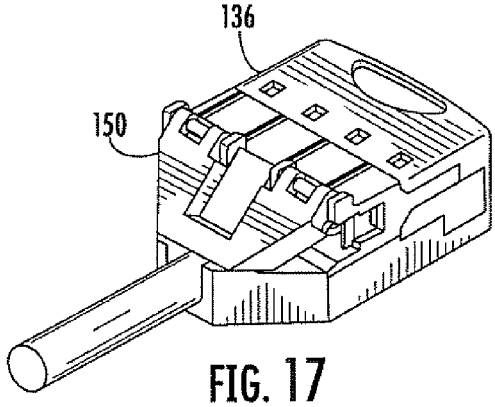
FIG. 17 (PRIOR ART)
FIG. 17 is a top perspective view of the prior art plug of FIG. 16.

Those skilled in this art will recognize that other configurations may be suitable for use herein. For example, although eight contacts 60 are illustrated and described herein, a plug with more or fewer contacts (such as plug 100, illustrated in FIG. 15, which has only two contacts) may employ a similar configuration. In some embodiments, one or more of the gripping pads 20, 34 may be omitted or may not be visually distinct from the remainder of the plug. The hinge 36 in the cover 30 may be formed with additional components (i.e., it may not be a "living hinge"). The contacts 60 may have a different configuration depending on the performance requirements of the plug. Other variations may also be apparent to those skilled in this art.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention.

The invention claimed is:

1. A 110-style patch cord, comprising:

a plug having opposed front and rear ends and a generally horizontal support surface;

a plurality of electrical contacts mounted in the plug, each contact including a generally vertically oriented blade, each of the blades being generally parallel but non-coplanar relative to each of the other blades, the blades having at least partially exposed front edges positioned above the support surface and defining a generally vertical first plane; and a cable with a plurality of conductors, wherein each contact is electrically connected to a respective one of the conductors, the cable extending from the front end of the plug;

wherein at least one anti-snagging gusset is mounted on the support surface in front of the first plane.

2. The patch cord defined in claim 1, wherein at least some of the blades are arranged in a generally horizontal row, and wherein the at least one gusset slopes upwardly to meet a lower edge of one of the blades in the generally horizontal row.

3. The patch cord defined in claim 1, wherein the at least one gusset is a plurality of gussets.

4. The patch cord defined in claim 3, wherein each of the plurality of gussets is substantially coplanar with a corresponding blade.

5. The patch cord defined in claim 3, wherein the plug has a ceiling, and wherein the ceiling does not extend forwardly beyond the first plane.

6. The patch cord defined in claim 5, further comprising discontinuous partitions that extend from the ceiling to the support surface, the blades being located in contact slots in the partitions.

7. The patch cord defined in claim 6, wherein each of the gussets merges with a respective partition.

8. The patch cord defined in claim 1, wherein the plug comprises a base and a separate cover.

9. The patch cord defined in claim 8, wherein the contacts and the at least one gusset are located on the base.

10. The patch cord defined in claim 8, wherein the cover includes generally horizontal grooves that receive contacts and generally vertical grooves intersecting with the horizontal grooves that receive individual conductors.

11. The patch cord defined in claim 8, wherein the cover includes a ceiling with a downwardly depending latch, the latch configured to be received by a patch panel, and wherein the ceiling is attached to the cover via a living hinge.

12. The patch cord defined in claim 8, wherein the cover includes a pair of generally forwardly-extending cord grip arms that grip the cord.

13. The patch cord defined in claim 10, wherein the cover includes a shelf with a plurality of apertures, each of the apertures positioned to receive and feed a pair of conductors to respective ones of the generally vertical slots.

14. The patch cord defined in claim 1, wherein the front end of the plug is rounded.

15. A method of terminating a patch cord having a plurality of electrical conductors, the conductors being arranged in differential pairs, the method comprising the steps of:

providing a base in which are mounted electrical contacts, each of the electrical contacts including a blade at one end and an insulation displacement contact (IDC) at the other end, the blades being generally vertically oriented, and each of the blades being generally parallel but non-coplanar relative to each of the other blades, arranged in one or more generally horizontal rows, and extending in a forward direction;

providing a cover comprising a plurality of generally vertically oriented grooves, each of the grooves sized to receive a conductor;

inserting a cable comprising the plurality of conductors into an aperture located on a forward end of the base;

inserting each of the conductors of the cable into a respective one of the grooves in the cover; and interconnecting the base and the cover such that the IDCs in the base form electrical contact with the conductors inserted in the grooves in the cover.

16. The method defined in claim 15, wherein the cover includes generally horizontal slots that intersect with respective generally vertical slots, the generally horizontal slots receiving the IDCs during the interconnecting step.

17. The method defined in claim 16, further comprising the step of threading pairs of conductors through apertures in a shelf on the cover prior to inserting the conductors into a respective groove.

18. The method defined in claim 15, wherein the interconnecting step includes latching the cover to the base via a latch located on the base.

19. The method defined in claim 15, wherein the cover includes a ceiling attached thereto via a living hinge.

20. The method defined in claim 15, wherein the cover includes forwardly-extending grip arms, and wherein the interconnecting step includes flexing the gripping arms with the base to clamp the arms onto the cable.

21. A patch cord, comprising:

a plug having opposed front and rear ends and a generally horizontal support surface;

a plurality of electrical contacts mounted in the plug, each contact including a generally vertically oriented blade, each of the blades being generally parallel but non-coplanar relative to each of the other blades, the blades having at least partially exposed front edges positioned above the support surface and defining a generally vertical first plane, wherein each of the electrical contacts has an insulation displacement contact (IDC) on an end opposite the blade; and a cable with a plurality of conductors, wherein each contact is electrically connected to a respective one of the conductors, the cable extending from the front end of the plug;

wherein at least one anti-snagging gusset is mounted on the support surface in front of the first plane.

* * * * *

UNITED STATES PATENT AND TRADEMARK OFFICE

CERTIFICATE OF CORRECTION

PATENT NO. : 7,503,799 B2
APPLICATION NO. : 11/845275
DATED : March 17, 2009
INVENTOR(S) : Keith et al.

It is certified that error appears in the above-identified patent and that said Letters Patent is hereby corrected as shown below:

On Title Page:

Item 73, Assignee: Please correct the Assignee "CommScope Inc.,"
to read -- CommScope Inc. of North Carolina --

Signed and Sealed this

Nineteenth Day of May, 2009

JOHN DOLL
*Acting Director of the United States Patent and Trademark Office*